US011795821B1

(12) United States Patent
Mangardich

(10) Patent No.: US 11,795,821 B1
(45) Date of Patent: Oct. 24, 2023

(54) ROTOR HAVING CRACK MITIGATOR

(71) Applicant: PRATT & WHITNEY CANADA CORP., Longueuil (CA)

(72) Inventor: Dikran Mangardich, Richmond Hill (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 18 days.

(21) Appl. No.: 17/658,461

(22) Filed: Apr. 8, 2022

(51) Int. Cl.
*F01D 5/04* (2006.01)

(52) U.S. Cl.
CPC ..... *F01D 5/048* (2013.01); *F05D 2220/323* (2013.01); *F05D 2250/294* (2013.01); *F05D 2260/941* (2013.01)

(58) Field of Classification Search
CPC .... F01D 5/043; F01D 5/048; F05D 2220/323; F05D 2250/294; F05D 2260/941; F05D 2260/94; F05D 2250/18; F05D 2250/181; F05D 2250/182; F05D 2250/60; F04D 29/284
See application file for complete search history.

(56) References Cited

U.S. PATENT DOCUMENTS 6,749,400 B2 6/2004 Dougherty et al.
7,189,062 B2 * 3/2007 Fukizawa ..... F04D 25/04 416/185
9,683,576 B2 * 6/2017 Herran ..... F04D 29/441
9,714,577 B2 7/2017 Kington et al.
10,385,864 B2 * 8/2019 Pham ..... F01D 5/048
2012/0183406 A1 * 7/2012 Yoshida ..... F01D 5/048 416/219 R
2013/0017091 A1 * 1/2013 Duong ..... F01D 5/048 416/193 A
2015/0226233 A1 * 8/2015 Yagi ..... F04D 29/662 416/144
2016/0003059 A1 * 1/2016 Otsubo ..... F01D 5/28 416/241 R

FOREIGN PATENT DOCUMENTS

CN 104903561 9/2015

* cited by examiner

*Primary Examiner* — Woody A Lee, Jr.
*Assistant Examiner* — Eric A Lange
(74) *Attorney, Agent, or Firm* — NORTON ROSE FULBRIGHT CANADA LLP

(57) ABSTRACT

A rotor for an aircraft engine, has: a hub extending circumferentially about a central axis, the hub having a bore, a gaspath-facing surface located radially outwardly of the bore relative to the central axis, a first face extending from the bore to the gaspath-facing surface, and a second face opposite the first face and extending from the bore to the gaspath-facing surface; blades circumferentially distributed about the central axis, the blades protruding away from the gaspath-facing surface of the hub; and a crack mitigator located on the first face, the crack mitigator extending circumferentially relative to the central axis, the crack mitigator extending axially from a baseline surface of the first face.

16 Claims, 4 Drawing Sheets

ROTOR HAVING CRACK MITIGATOR

TECHNICAL FIELD

The application relates generally to aircraft engines and, more particularly, to rotors, such as compressor and turbine rotors, used in such engines.

BACKGROUND

An aircraft engine rotor disc, such as a compressor rotor disc or a turbine rotor disc, is subjected to low cycle fatigue which can result from centrifugal and/or thermal loads over extended periods. In certain circumstances, cracks may form on the disc due to such low cycle fatigue. The loading on the disc resolves into is a combination of radial and hoop stresses. Depending on location on the disc, one of the radial stress and the hoop stress dominates. At locations where the stress transitions from being radial dominant to hoop dominant, cracks may initiate at any angle. Cracks extending in a radial direction are undesired since they may propagate at undesired locations. Improvements are therefore sought.

SUMMARY

In one aspect, there is provided a rotor for an aircraft engine, comprising: a hub extending circumferentially about a central axis, the hub having a bore, a gaspath-facing surface located radially outwardly of the bore relative to the central axis, a first face extending from the bore to the gaspath-facing surface, and a second face opposite the first face and extending from the bore to the gaspath-facing surface; blades circumferentially distributed about the central axis, the blades protruding away from the gaspath-facing surface of the hub; and a crack mitigator located on the first face, the crack mitigator extending circumferentially relative to the central axis, the crack mitigator extending axially from a baseline surface of the first face.

The rotor may include in of the following features, in any combinations.

In some embodiments, the crack mitigator is located radially outwardly of a mid-plane of the first face, the mid-plane located halfway between the bore and a radially outward-most location of the gaspath-facing surface.

In some embodiments, the crack mitigator includes at least one groove extending in an axial direction relative to the central axis from the first face.

In some embodiments, the at least one groove has a depth (D1) extending in the axial direction and a height (H1) extending in a radial direction relative to the central axis, a ratio of the depth (D1) to the height (H1) ranging from 0.01 to 0.5.

In some embodiments, the at least one groove includes at least two grooves radially offset from one another.

In some embodiments, a ratio of a distance (S12) between the at least two grooves to a sum of heights (H1, H2) of the at least two grooves ranges from 0.25 to 5, the heights extending in a radial direction relative to the central axis.

In some embodiments, the crack mitigator includes at least one bump extending in an axial direction relative to the central axis from the first face.

In some embodiments, the at least one bump has a depth (D1) extending in the axial direction and a height (H1) extending in a radial direction relative to the central axis, a ratio of the depth (D1) to the height (H1) ranging from 0.01 to 0.5.

In some embodiments, the at least one bump includes at least two bumps radially offset from one another.

In some embodiments, a ratio of a distance (S12) between the at least two bumps to a sum of heights (H1, H2) of the at least two bumps ranges from 0.25 to 5, the heights extending in a radial direction relative to the central axis.

In some embodiments, the crack mitigator includes at least one bump and at least one groove.

In some embodiments, the at least one bump is located radially outwardly of the at least one groove.

In another aspect, there is provided a compressor section of an aircraft engine, the compressor section having an impeller rotatable about a central axis, the impeller comprising: a hub extending circumferentially about a central axis, the hub having a bore, a gaspath-facing surface located radially outwardly of the bore relative to the central axis, a first face extending from the bore to the gaspath-facing surface, and a second face opposite the first face and extending from the bore to the gaspath-facing surface; blades circumferentially distributed about the central axis, the blades protruding from the gaspath-facing surface of the hub; and a crack mitigator located on the first face and extending circumferentially about the central axis, the crack mitigator extending from a baseline surface of the first face.

The compressor section may include any of the following features, in any combinations.

In some embodiments, the crack mitigator is located radially outwardly of a mid-plane of the first face, the mid-plane located halfway between the bore and a radially outward-most location of the gaspath-facing surface.

In some embodiments, the crack mitigator is at least one groove extending in an axial direction relative to the central axis from the first face, the at least one groove having a depth (D1) extending in the axial direction and a height (H1) extending in a radial direction relative to the central axis, a ratio of the depth (D1) to the height (H1) ranging from 0.01 to 0.5.

In some embodiments, the crack mitigator is at least one bump extending in an axial direction relative to the central axis from the first face, the at least one bump having a depth (D1) extending in the axial direction and a height (H1) extending in a radial direction relative to the central axis, a ratio of the depth (D1) to the height (H1) ranging from 0.01 to 0.5.

In some embodiments, the crack mitigator is a first crack mitigator, a second crack mitigator radially offset from the first crack mitigator, a ratio of a distance (S12) between the first crack mitigator and the second crack mitigator to a sum of heights (H1, H2) of the first crack mitigator and the second crack mitigator ranging from 0.25 to 5, the heights extending in a radial direction relative to the central axis.

In some embodiments, the crack mitigator is a first crack mitigator, a second crack mitigator radially offset from the first crack mitigator, the first crack mitigator being a bump, the second crack mitigator being a groove, the bump located radially outwardly of the groove.

In some embodiments, the crack mitigator is a first crack mitigator, a second crack mitigator radially offset from the first crack mitigator, the first crack mitigator being a bump, the second crack mitigator being a bump.

In some embodiments, the crack mitigator is a first crack mitigator, a second crack mitigator radially offset from the first crack mitigator, the first crack mitigator being a groove, the second crack mitigator being a groove.

BRIEF DESCRIPTION OF THE DRAWINGS

Reference is now made to the accompanying figures in which.

DETAILED DESCRIPTION

Figure 1:
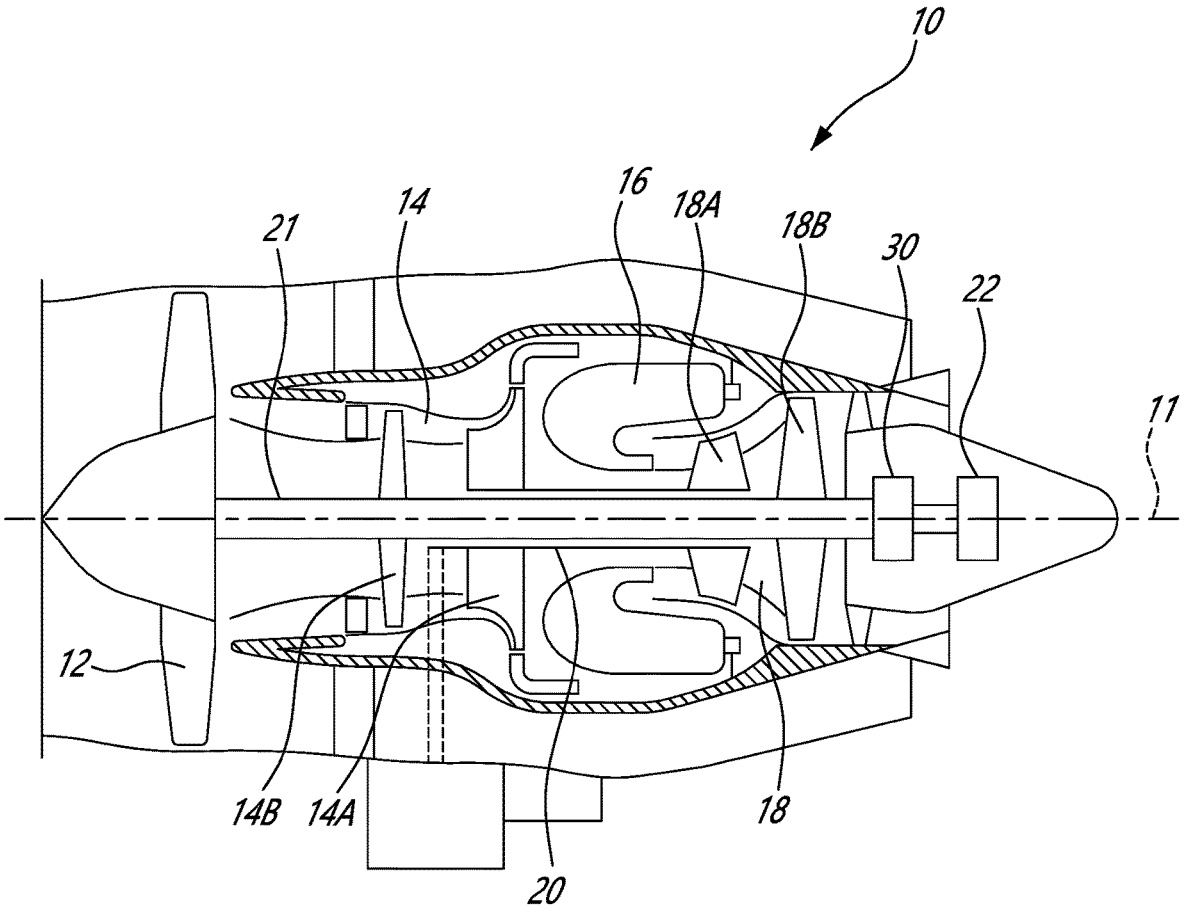
FIG. 1 is a cross-sectional view of an aircraft engine depicted as a gas turbine engine.

FIG. 1 illustrates an aircraft engine depicted as a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 are rotatable about a central axis 11 of the gas turbine engine 10. In the embodiment shown, the gas turbine engine 10 comprises a high-pressure spool having a high-pressure shaft 20 drivingly engaging a high-pressure turbine 18A of the turbine section 18 to a high-pressure compressor 14A of the compressor section 14, and a low-pressure spool having a low-pressure shaft 21 drivingly engaging a low-pressure turbine 18B of the turbine section to a low-pressure compressor 14B of the compressor section 14 and drivingly engaged to the fan 12. It will be understood that the contents of the present disclosure may be applicable to any suitable engines, such as turboprops and turboshafts, and reciprocating engines, such as piston and rotary engines without departing from the scope of the present disclosure.

Figure 2:
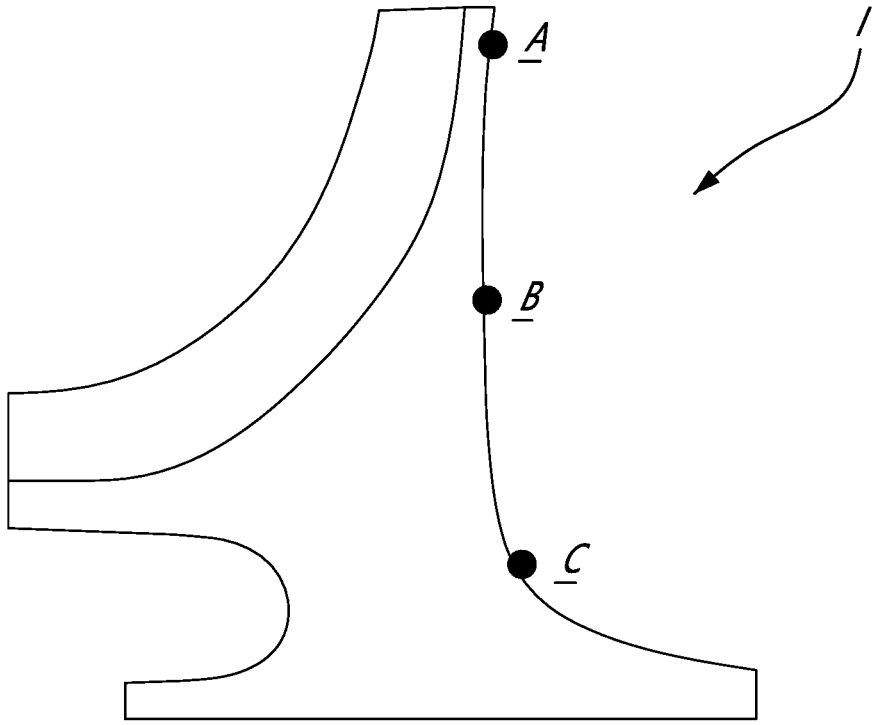
FIG. 2 is a cross-sectional view of an impeller that may be used with the gas turbine engine of FIG. 1.
Figure 3:
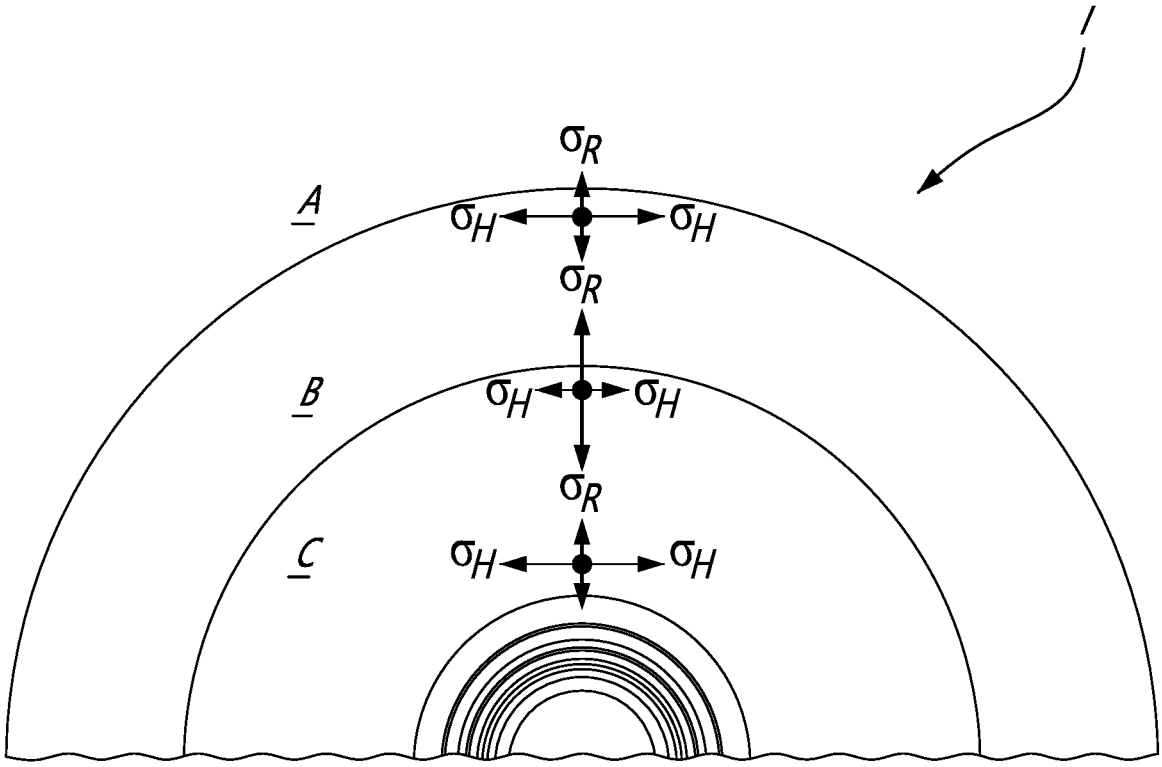
FIG. 3 is a back view of the impeller of FIG. 2.

Referring to FIGS. 2-3, in the embodiment shown, the compressor section 14, more specifically the high-pressure compressor 14A, includes an impeller I. The impeller I is rotatable about the central axis 11 for pressurizing air. The impeller I has a back face including three zones A, B, C disposed radially inward one another; zone C being the closest to the central axis 11. Depending on the location, stresses imparted on the impeller I as a result of its rotation about the central axis 11 vary from being dominant in a circumferential direction or in a radial direction.

Following prolonged utilization, a fatigue crack may form on a hub of the impeller I. Damage tolerance methods and tools can be used to determine the remaining crack propagation life and trajectory of the crack leading up to the need to replace the impeller I. Depending of where a crack initiates, it may affect the way said crack propagates. For instance, at higher and lower radii, such as within zones A and C, the dominant low-cycle fatigue stress is along a circumferential direction relative to the central axis 11 (i.e., hoop dominated). At a mid-radius location, such as within zone B, the dominant low-cycle fatigue stress is along a radial direction relative to the central axis 11. Length of arrows presented in FIG. 3 are indicative of which component of the stress is greater. In FIG. 3, $\sigma_H$ aid denotes the hoop stress whereas $\sigma_R$ denotes the radial stress. During the transition of stress from being radially dominated to hoop dominated, there is a location where the bi-axiality (ratio of hoop stress to radial stress) is equal to one. This may occur between zones A and B and between zones B and C. At these locations where the bi-axiality is equal to or proximate to one, cracks may theoretically initiate at any angle. If a crack initiates on the disc profile of a compressor, the resulting trajectory of the crack is a function of the initial crack orientation, and the resulting dominant LCF stress field.

When a crack initiates from a hoop dominated stress field (e.g., zones A or C) or where a bi-axiality ratio of one, the crack can initiate either in the radial direction, or at an angle. If a crack initiates at an angle and it is left to propagate, it may continue to grow at the same angle it initiated until it enters a unique stress field where both ends of the crack are dominated by hoop loading. This may result in the crack to turn on opposite ends in radially opposite directions.

When a crack initiates from a radially dominated stress field (e.g., zone B), this crack will likely be perpendicular to the radial load. When left to propagate, this crack may continue to grow perpendicular to the radial load until it enters a higher radius, where hoop loading begins to dominate. In this case, the hoop loading turns the crack such that both ends of the crack propagate radially outwardly toward a gaspath-facing surface of the impeller. For safety reasons, it is preferred to have a crack that propagate perpendicularly to the radial load and grow toward the gaspath-facing surface, instead of growing toward the bore.

Regardless of stress state, should a crack initiate in a radial direction, the radial load may never contribute to the growth of the crack. In some cases, only the hoop load may drive the growth of the crack toward the bore.

The present disclosure proposes a rotor presenting crack mitigators, which may be in the form of bumps or grooves, that are used to reduce risks of cracks growing towards a bore of the rotor. In some embodiments, the crack mitigators may introduce a stress concentration factor in a radial flow stress direction as well as increase the local nominal stress. This may help to maximise the radial contribution of crack growth. These crack mitigators may increase a size of an area on the impeller I where a crack would grow toward the gaspath-facing surface, instead of growing toward the bore. These crack mitigators may be used for compressor rotors where the resulting disc stresses may be low and the corresponding low cycle fatigue life may be high. The crack mitigators may be designed to avoid altering the minimum life of the rotor while minimizing risks of cracks propagating towards the bore.

Figure 4:
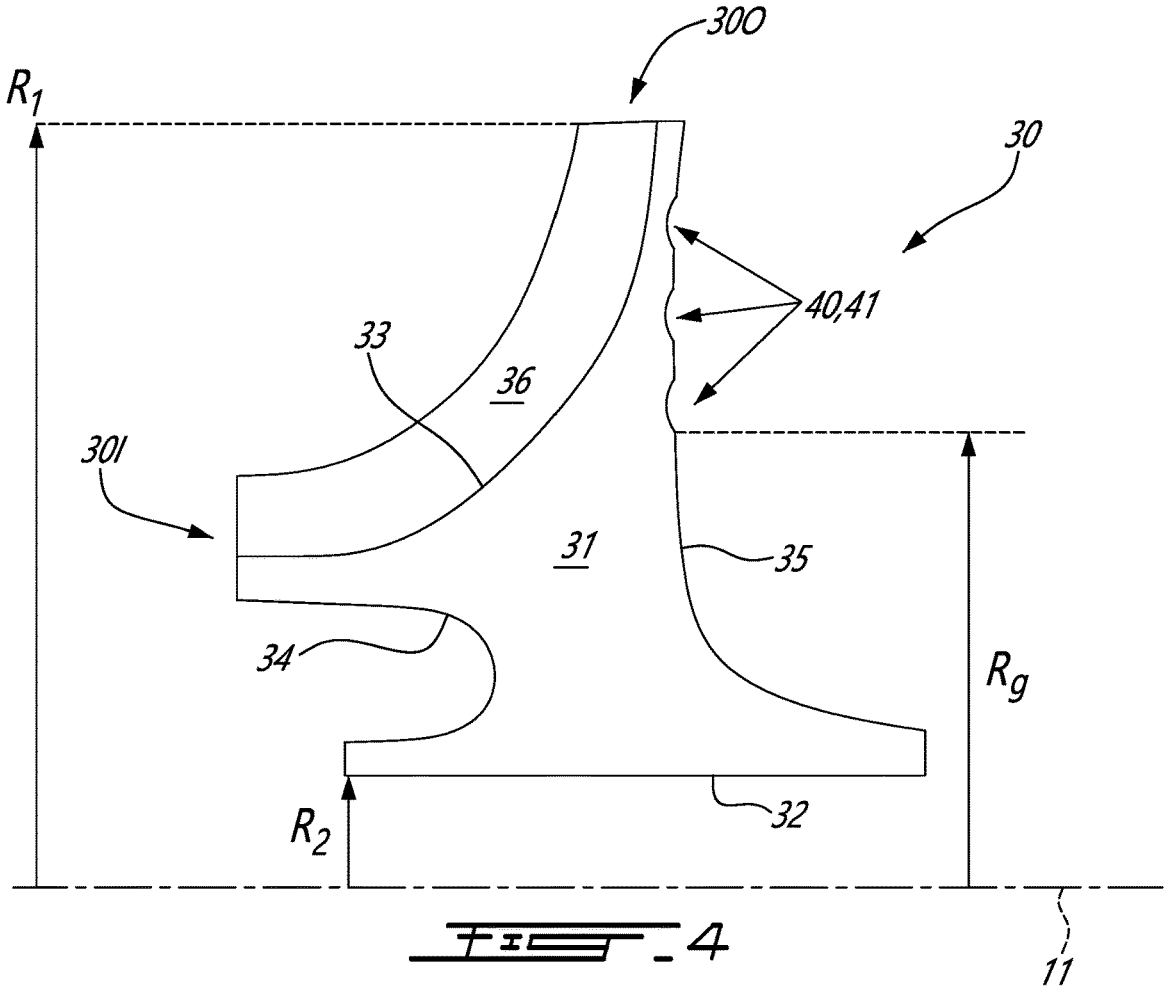
FIG. 4 is a cross-sectional view of an impeller in accordance with one embodiment for the gas turbine engine of FIG. 1.

Referring now to FIG. 4, an impeller for gas turbine engine 10 of FIG. 1 is shown at 30. The impeller 30 may be part of the high-pressure compressor 14A. It will be appreciated that the principles of the present disclosure may apply to any rotor such as, for instance, a compressor rotor of an axial compressor, an impeller of a turbine section, a turbine rotor of an axial turbine, and so on.

The impeller 30 has a hub 31 that extends circumferential about the central axis 11 of the gas turbine engine 10. The hub 31 has a bore 32 and a gaspath-facing surface 33 located radially outwardly of the bore 32 relative to the central axis 11. The hub 31 includes a front face 34 that extends from the bore 32 to the gaspath-facing surface 33. The hub 31 includes a back face 35 that extends from the bore 32 to the gaspath-facing surface 33. The impeller 30 includes blades 36 that are circumferentially distributed about the central axis 11. The blades 36 protrude from the gaspath-facing surface 33 of the hub 31. In the embodiment shown, the impeller 30 has an inlet 301 that is oriented substantially axially relative to the central axis 11 and an outlet 300 that is oriented substantially radially relative to the central axis 11. Hence, the blades 36 and flow paths defined between each two adjacent ones of the blades 36 curve from a substantially axial orientation to a substantially radial orientation relative to the central axis 11.

The impeller 30 may include one or more crack mitigator 40 that are use to at least partially alleviate effects of cracks on the hub 31 of the impeller 30. In the embodiment shown, the crack mitigators 40 are grooves 41 located on the back face 35 of the hub 31. It will be appreciated that the crack mitigators 40 may be located at any suitable locations on the hub 31. For instance, the crack mitigators may be located on one or more of a front face and a back face of a disc of a rotor of an axial compressor or turbine.

The grooves 41 extend circumferentially about the central axis 11. Although three grooves 41 are shown in FIG. 4, the hub 31 may alternatively include one, two, or more than three grooves without departing from the scope of the present disclosure. The grooves 41 are radially offset from one another. The grooves 41 may be radially spaced apart from one another. Any suitable number of grooves is contemplated. The grooves 41 may extend continuously around a full circumference about the central axis 11. The grooves 41 may extend circumferentially about a portion of the circumference (i.e., circumferentially discontinuous). For instance, each of the grooves 41 may include a plurality of groove segments circumferentially distributed about the central axis 11; each of the groove segments extending circumferentially along a portion of the circumference of the hub 31.

Figure 5:
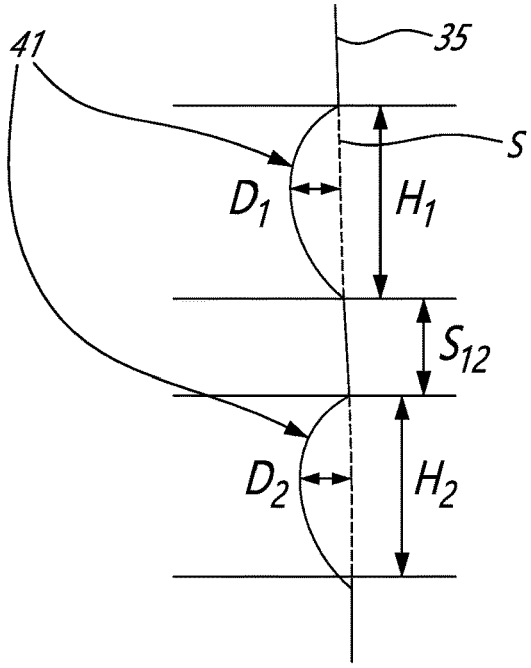
FIG. 5 is an enlarged view of a portion of FIG. 4.

Referring to FIGS. 4-5, the grooves 41 extend from a baseline surface S of the back face 35 of the hub 31. The baseline surface S is shown with a dashed line in FIG. 5. In the present embodiment, the grooves 41 extend from the baseline surface S towards the front face 34 in a direction having an axial component relative to the central axis 11. In other words, the grooves 41 extend within a body of the hub 31. Material may therefore be removed form the hub 31 to create the grooves 41. It will be appreciated that break edge (e.g., fillets) may be present at intersections between the grooves 41 and the baseline surface S. These break edges may be from 0.003 inch to 0.015 inch in radius. Corner fillets may be of 0.005 inch to 0.020 inch in radius.

As shown in FIG. 4, the crack mitigators 40 may be located radially outwardly of a mid-plane of the back face 35. The mid-plane is located halfway between the bore 32 and a radially outward-most location of the gaspath-facing surface 33. In the present case, the radially outward-most location of the gaspath-facing surface 33 is located at the outlet 300 of the impeller 30. In other words, the mid-plane may be located at a radial distance $R_g$ from the central axis 11. The radial distance $R_g$ corresponds to half of a first radial distance $R_1$ from the central axis 11 to the radially outward-most location of the gaspath-facing surface 33 plus half of a second radial distance R2 from the central axis 11 to the bore 32.

As shown more particularly on FIG. 5, the groove 41 has a depth $D_1$ extending in the axial direction and a height $H_1$ extending in a radial direction relative to the central axis 11. A ratio of the depth $D_1$ to the height $H_1$ may range from 0.01 to 0.5. A ratio of a distance 512 between two adjacent grooves 41 to a sum of heights $H_1$, $H_2$ of the two adjacent grooves may range from 0.1 to 5, in some cases from 0.25 to 5. The heights $H_1$, $H_2$ may extend in the radial direction relative to the central axis 11.

Figure 6:
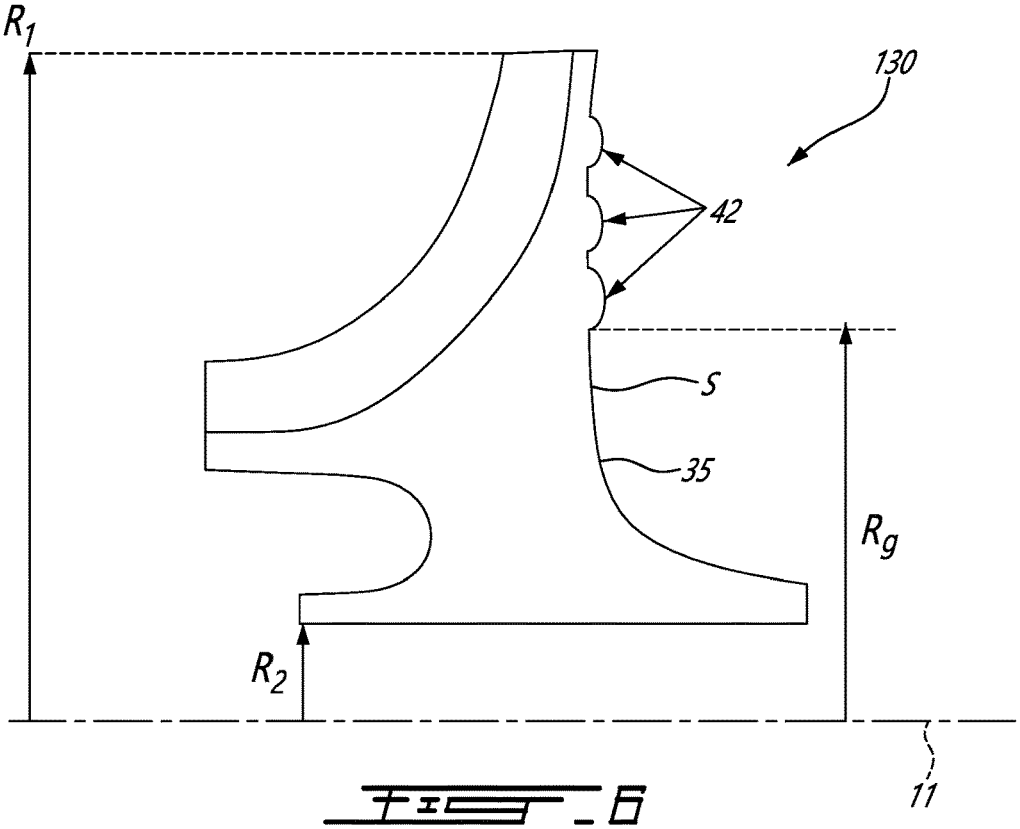
FIG. 6 is a cross-sectional view of an impeller in accordance with another embodiment for the gas turbine engine of FIG. 1.

Referring now to FIG. 6, another embodiment of an impeller is shown at 130. For the sake of conciseness, only features differing from the impeller 30 described above with reference to FIGS. 4-5 are described below.

In the embodiment shown, the impeller 130 has crack mitigators 40 provided in the form of bumps 42. It will be appreciated that the crack mitigators 40 may be located at any suitable locations on the hub 31. For instance, the crack mitigators may be located on one or more of a front face and a back face of a disc of a rotor of an axial compressor or turbine.

The bumps 42 extend circumferentially about the central axis 11. Although three bumps 42 are shown in FIG. 4, the hub 31 may alternatively include one, two, or more than three bumps without departing from the scope of the present disclosure. The bumps 42 are radially offset from one another. The bumps 42 may be radially spaced apart from one another. Any suitable number of bumps is contemplated. The bumps 42 may extend continuously around a full circumference about the central axis 11. The bumps 42 may extend circumferentially about a portion of the circumference (i.e., circumferentially discontinuous). For instance, each of the bumps 42 may include a plurality of bump segments circumferentially distributed about the central axis 11; each of the bump segments extending circumferentially along a portion of the circumference of the hub 31.

The bumps 42 extend from the baseline surface S of the back face 35 of the hub 31. In the present embodiment, the bumps 42 extend from the baseline surface S away from the front face 34 and away from the back face 35 in the direction having the axial component relative to the central axis 11. In other words, the bumps 42 protrude from a body of the hub 31. Material may therefore be added to the hub 31 to create the bumps 42. Intersections between the baseline surface S and the bumps 42 may be smooth. In other words, fillets may be present at those intersections.

As for the grooves 41, the bumps 42 may be located radially outwardly of the mid-plane of the back face 35. The bumps 42 may have the same dimensions of the grooves 41. That is, the bumps 42 may have a depth $D_1$ extending in the axial direction and a height $H_1$ extending in a radial direction relative to the central axis 11. A ratio of the depth $D_1$ to the height $H_1$ may range from 0.01 to 0.5. A ratio of a distance $S_{12}$ between two adjacent bumps 42 to a sum of heights $H_1$, $H_2$ of the two adjacent bumps 42 may range from 0.1 to 0.5, in some cases from 0.25 to 5. The heights $H_1$, $H_2$ may extend in the radial direction relative to the central axis 11.

Figure 7:
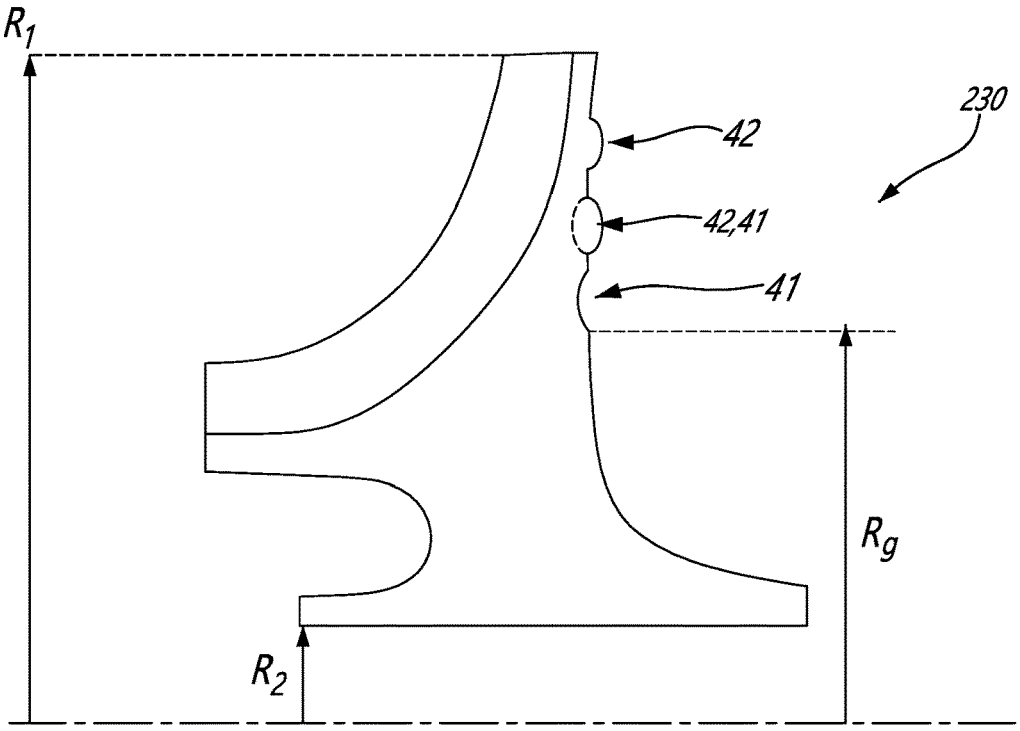
FIG. 7 is a cross-sectional view of an impeller in accordance with another embodiment for the gas turbine engine of FIG. 1.

Referring now to FIG. 7, another embodiment of an impeller is shown at 230. For the sake of conciseness, only features differing from the impeller 30 described above with reference to FIGS. 4-5 are described below.

In the embodiment shown, the impeller 230 includes crack mitigators, which are provided here as a combination of grooves 41 and bumps 42. The grooves 41 may be effective at directing a crack whereas the bumps 42 may be effective at slowing down crack propagation. Consequently, a combination of bump(s) 42 and groove(s) 41 may redirect new cracks in the circumferential direction and slow down propagation of cracks that tend to propagate towards the bore 32.

In the embodiment shown, the impeller 230 includes at least one grooves 41 as described above with reference to FIGS. 4-5 and at least one bump as described above with reference to FIG. 6. The bump 42 may be located radially outwardly of the groove 41.

Referring to FIGS. 4-7, the grooves 41 and the bumps 42 may have any suitable profile. For instance, the grooves 41 and the bumps 42 are shown as having an arc shaped profile (e.g., semi-circular) in FIGS. 4 to 7. Alternatively, the grooves 41 and the bumps 42 may have a profile having a rectangular, elliptical, or any other suitable shapes. Fillets may be used to join the grooves 41 and the bumps 42 to the baseline surface S of the back face 35 of the hub 31 of the impeller 30. The grooves 41 and the bumps 42 may have a width that may vary in a circumferential direction relative to the central axis 11. The grooves 41 and the bumps 42 may have a height that may vary in the circumferential direction. In other words, the height and/or the width may be non-uniform.

It will be appreciated that the crack mitigator as defined herein may include any of the following, in any combination: a protrusion, a projection, a stiffener, a tab, a flange, a pin, a cavity, an aperture, and a recess. All such structures are understood to constitute a structure that mitigates cracks and forms a crack mitigator as defined herein.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A rotor for an aircraft engine, comprising:

a hub extending circumferentially about a central axis, the hub having a bore, a gaspath-facing surface located radially outwardly of the bore relative to the central axis, a first face extending from the bore to the gaspath-facing surface, and a second face opposite the first face and extending from the bore to the gaspath-facing surface;

blades circumferentially distributed about the central axis, the blades protruding away from the gaspath-facing surface of the hub; and at least two crack mitigators each being a groove or a bump, the groove or the bump extending in an axial direction relative to the central axis from the first face, the at least two crack mitigators radially offset from one another and located on the first face, the at least two crack mitigators extending circumferentially relative to the central axis, the at least two crack mitigators extending axially from a baseline surface of the first face, the at least two crack mitigators having a height ($H_1$) extending in a radial direction relative to the central axis and a depth ($D_1$) extending in the axial direction relative to the central axis, the height greater than the depth, a ratio of the depth (D1) to the height ($H_1$) ranges from 0.01 to 0.5, a portion of the baseline surface located radially between the bore and a radially-inner most one of the at least two crack mitigators.

2. The rotor of claim 1, wherein the at least two crack mitigators are located radially outwardly of a mid-plane of the first face, the mid-plane located halfway between the bore and a radially outward-most location of the gaspath-facing surface.

3. The rotor of claim 1, wherein the at least two crack mitigators are at least two grooves, a ratio of a distance ($S_{12}$) between the at least two grooves to a sum of heights ($H_1$, $H_2$) of the at least two grooves ranging from 0.25 to 5, the heights extending in a radial direction relative to the central axis.

4. The rotor of claim 1, wherein the at least two crack mitigators are at least two bumps, a ratio of a distance (S12) between the at least two bumps to a sum of heights (H1, H2) of the at least two bumps ranging from 0.25 to 5, the heights extending in a radial direction relative to the central axis.

5. The rotor of claim 1, wherein the at least two crack mitigators include at least one bump and at least one groove.

6. The rotor of claim 5, wherein the at least one bump is located radially outwardly of the at least one groove.

7. A compressor section of an aircraft engine, the compressor section having an impeller rotatable about a central axis, the impeller comprising:

a hub extending circumferentially about a central axis, the hub having a bore, a gaspath-facing surface located radially outwardly of the bore relative to the central axis, a first face extending from the bore to the gaspath-facing surface, and a second face opposite the first face and extending from the bore to the gaspath-facing surface;

blades circumferentially distributed about the central axis, the blades protruding from the gaspath-facing surface of the hub; and at least two crack mitigators each being a groove or a bump, the groove or the bump extending in an axial direction relative to the central axis from the first face, the at least two crack mitigators radially offset from one another and located on the first face and extending circumferentially about the central axis, the at least two crack mitigators extending from a baseline surface of the first face, the at least two crack mitigators having a height ($H_1$) extending in a radial direction relative to the central axis and a depth ($D_1$) extending in the axial direction relative to the central axis, the height greater than the depth, a ratio of the depth (D1) to the height ($H_1$) ranges from 0.01 to 0.5, a portion of the baseline surface located radially between the bore and a radially-inner most one of the at least two crack mitigators.

8. The compressor section of claim 7, wherein the at least two crack mitigators are located radially outwardly of a mid-plane of the first face, the mid-plane located halfway between the bore and a radially outward-most location of the gaspath-facing surface.

9. The compressor section of claim 7, wherein a ratio of a distance ($S_{12}$) between the at least two crack mitigators to a sum of heights ($H_1$, $H_2$) of the at least two crack mitigators ranging from 0.25 to 5, the heights extending in a radial direction relative to the central axis.

10. The compressor section of claim 7, wherein one of the at least two crack mitigators is a bump, the other of the at least two crack mitigators being a groove, the bump located radially outwardly of the groove.

11. The compressor section of claim 7, wherein the at least two crack mitigators are bumps.

12. The compressor section of claim 7, wherein the at least two crack mitigators are grooves.

13. A rotor for an aircraft engine, comprising:

a hub extending circumferentially about a central axis, the hub having a bore, a gaspath-facing surface located radially outwardly of the bore relative to the central axis, a first face extending from the bore to the gaspath-facing surface, and a second face opposite the first face and extending from the bore to the gaspath-facing surface;

blades circumferentially distributed about the central axis, the blades protruding away from the gaspath-facing surface of the hub; and at least two crack mitigators each being a groove or a bump, the groove or the bump extending in an axial direction relative to the central axis from the first face, the at least two crack mitigators radially offset from one another and located on the first face, the at least two crack mitigators extending circumferentially relative to the central axis, the at least two crack mitigators extending axially from a baseline surface of the first face, the at least two crack mitigators having a height ($H_1$) extending in a radial direction relative to the central axis and a depth ($D_1$) extending in the axial direction relative to the central axis, the height greater than the depth, a portion of the baseline surface located radially between the bore and a radially-inner most one of the at least two crack mitigators, a ratio of a distance ($S_{12}$) between the at least two crack mitigators to a sum of heights ($H_1$, $H_2$) of the at least two crack mitigators ranging from 0.25 to 5, the heights extending in a radial direction relative to the central axis.

14. The rotor of claim 13, wherein the at least two crack mitigators are bumps.

15. The rotor of claim 13, wherein the at least two crack mitigators are grooves.

16. The rotor of claim 13, wherein one of the at least two crack mitigators is a bump, the other of the at least two crack mitigators being a groove, the bump located radially outwardly of the groove.

* * * * *